US005741205A

United States Patent [19]

Doll et al.

[11] Patent Number: 5,741,205

[45] Date of Patent: Apr. 21, 1998

[54] EXERCISE APPARATUS PEDAL MECHANISM

[75] Inventors: James W. Doll, Gurnee; David J. Thum, Chicago, both of Ill.; Michael A. Niemotka, Gainsville, Fla.; Steven M. Lenz, Naperville; Mark C. Termion, Winfield, both of Ill.

[73] Assignee: Life Fitness, Franklin Park, Ill.

[21] Appl. No.: 568,699

[22] Filed: Dec. 7, 1995

[51] Int. Cl.[6] ..... A63B 22/04

[52] U.S. Cl. ..... 482/52

[58] Field of Search ..... 482/52

[56] References Cited

U.S. PATENT DOCUMENTS

| | | | |
|---|---|---|---|
| Re. 34,959 | 5/1995 | Potts | 482/52 |
| 3,511,500 | 5/1970 | Dunn . | |
| 3,747,924 | 7/1973 | Champoux . | |
| 3,970,302 | 7/1976 | McFee . | |
| 4,643,419 | 2/1987 | Hyde . | |
| 4,708,338 | 11/1987 | Potts | 482/52 |
| 4,949,993 | 8/1990 | Stark | 482/52 |
| 5,135,447 | 8/1992 | Robards, Jr. et al. . | |
| 5,183,448 | 2/1993 | Wang | 482/52 |
| 5,238,462 | 8/1993 | Cinke et al. . | |
| 5,263,909 | 11/1993 | Ehrenfried . | |
| 5,299,993 | 4/1994 | Habling . | |
| 5,336,142 | 8/1994 | Dalebout et al. | 482/52 |
| 5,336,143 | 8/1994 | Wu | 482/52 |
| 5,403,252 | 4/1995 | Leon et al. . | |
| 5,404,771 | 4/1995 | Soma . | |

FOREIGN PATENT DOCUMENTS

| | | | |
|---|---|---|---|
| WO9409857 | 5/1994 | WIPO | 482/52 |

*Primary Examiner*—Richard J. Apley
*Assistant Examiner*—William LaMarca
*Attorney, Agent, or Firm*—Michael B. McMurry; Kathleen A. Ryan

[57] ABSTRACT

In a simulated stairclimbing apparatus having a pair of pedal members rotatably attached at one end to the frame of the apparatus and having a foot pedal rotatably attached to the other end of each pedal member, a pulley is attached to each pedal and another pair of pulleys is attached to the frame where flexible members such as cables are engaged with the pedal and frame pulleys for each pedal member so as to keep the pedals level through the vertical motion of the pedals. In another arrangement, a pair of flexible members are rotatably attached to each pedal and to the frame where the pedal member is located between each of the two flexible members so as to keep the pedals level through the vertical motion of the pedals.

18 Claims, 3 Drawing Sheets

EXERCISE APPARATUS PEDAL MECHANISM

FIELD OF THE INVENTION

The invention relates to simulated stairclimbing apparatus and in particular to stairclimbing apparatus pedal mechanisms.

BACKGROUND OF THE INVENTION

There are two basic types of simulated stairclimbing apparatus. The first type of stairclimber is typically referred to a dependent step type machine in which a pair of foot pedals are attached to foot pedal members that in turn are connected together by a belt or a chain. The belt or chain is then connected to a resistance mechanism. Examples of such a stairclimber are shown in U.S. Pat. Nos. 3,747,924, 5,135,447 and 5,238,462. The second type of stairclimber, typically termed an independent step type machine, includes a resistance mechanism that permits the pedals to move independently of one another. Examples of independent step machines are shown in U.S. Pat. Nos. Re. 34,959, 3,747,924, 5,183,448, 5,263,909, 5,299,993 and 5,336,143.

The pedal members in the above described stairclimbers tend to move in an arc and if the foot pedals are rigidly attached to the pedal members, as shown in the apparatus described in U.S. Pat. Nos. 5,135,447 and 5,238,462, the pedals will tilt forward and back which some users find undesirable. As a result some stairclimbers, such as the independent step types identified above as well as some dependent step types, utilize an articulated assembly to connect the foot pedals to the pedal members and frame that is intended to maintain the foot pedals level in the horizontal plane. These articulated assemblies include a pair of rigid arms which are pivotally connected to both the foot pedal and the frame.

These articulated assemblies utilizing rigid arms have the disadvantage of being stiff and inflexible with respect to providing a foot motion which is coordinated with the vertical motion of the pedal members. In particular these assemblies do not provide a convient mechanism for adjusting the level angle of the pedal. Also, bearing clearances in these types of assemblies, especially with wear, often lead to looseness in the assembly.

SUMMARY OF THE INVENTION

It is therefore an object of the invention to provide a stairclimber pedal mechanism having a foot pedal connected to a vertically pivoting pedal member that utilizes a pair of flexible members in combination with the pedal member to maintain the foot pedal in a predetermined orientation with respect to the horizontal plane as the pedal member moves up and down.

It is a further object of the invention to provide a stairclimber pedal mechanism having a pedal connected to a pedal member wherein the foot pedal is maintained in a substantially level orientation by allowing the pedal to rotate with respect to the pedal member and utilizing a pair of flexible members, such as cables, to connect the pedal to the stairclimber frame.

It is another object of the invention to provide a stairclimber mechanism having a pedal connected to a pedal member where the foot pedal is maintained in a predetermined orientation by allowing the pedal to rotate with respect to the pedal member and utilizing a cable engaged with both a pulley fixed to the pedal and a pulley fixed to the frame. To maintain adequate tension in the cable, the two ends of the cable can be connected by a tensioning device or one of the pulleys can be secured within a slot and moved to seperate the pulleys.

It is an additional object of the invention to provide a stairclimber mechanism having a pedal connected to a pedal member where the foot pedal is maintained in a substantially level orientation by allowing the pedal to rotate with respect to the pedal member and utilizing a belt engaged with both a pulley fixed to the pedal and a pulley fixed to the frame.

DETAILED DESCRIPTION OF THE INVENTION

Figure 1:
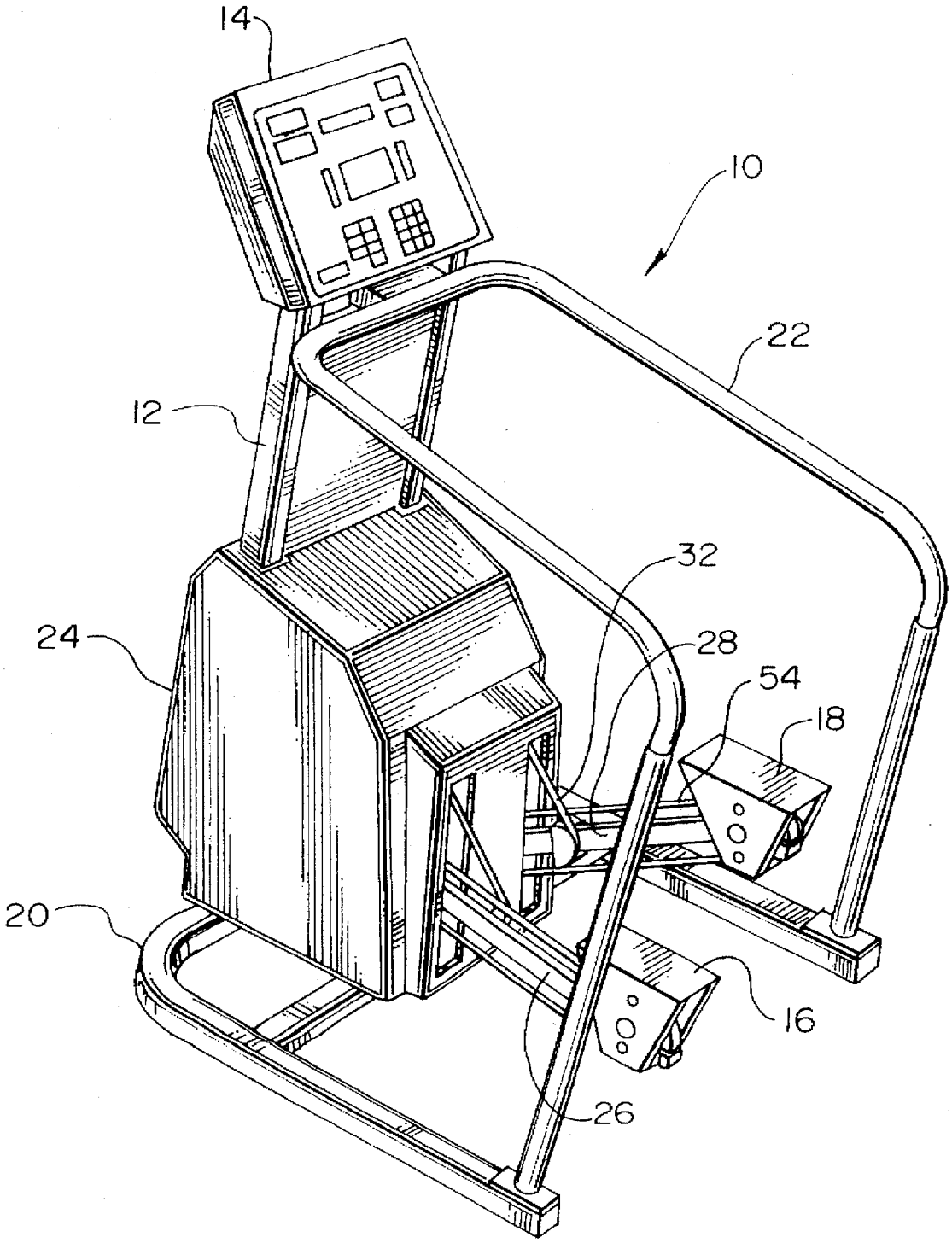
FIG. 1 is a perspective view of a stairclimbing apparatus in having a pedal mechanism in accordance with the invention.

FIG. 1 illustrates an independent step type simulated stairclimbing apparatus 10 that includes a frame 12, a control panel 14 and a pair of foot pedals 16 and 18. In the embodiment of the stairclimber 10 shown in FIG. 1, the frame 12 is attached to a base 20, a tubular section 22, configured for use as a pair of handrails, and a housing 24. The foot pedals 16 and 18 are rotatably attached to a pair of pedal members 26 and 28 which in turn are pivotally mounted, as illustrated in detail in FIG. 2, to the frame 12. Because the pedal members 26 and 28 are pivotally connected to the frame 12, a user can, by standing on the foot pedals 16 and 18 and holding on to the handrails 22, vertically reciprocate the foot pedals 16 and 18 to simulate stairclimbing.

Figure 2:
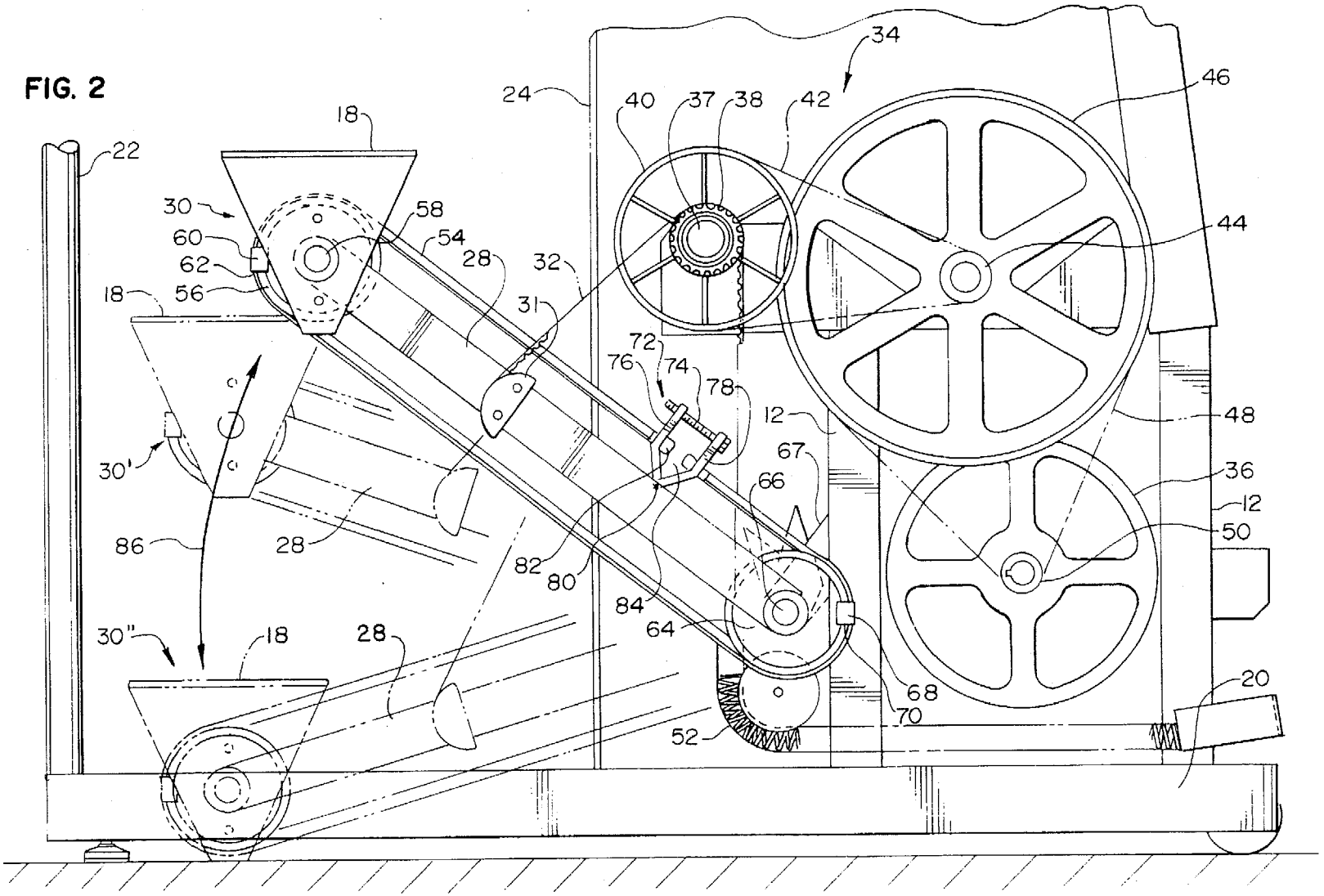
FIG. 2 is a sectioned away side view of the stairclimbing apparatus of FIG. 1 illustrating a first embodiment of the pedal mechanism utilizing a cable and pulley arrangement.

FIG. 2 is a side view of the stairclimber 10 of FIG. 1 which provides an illustration of the preferred embodiment of a pedal mechanism including the foot pedal 18 and the pedal member 28 in an upper step position 30, an intermmedate step position 30' and a lower step position 30". For simplicity of explanation, only the one pedal mechanism 30 is shown in FIG. 2 although it should be understood that the stairclimber 10 will include an identical pedal mechanism for the foot pedal 16. In the stairclimber 10 shown in FIG. 2, the pedal member 28 is connected by a toothed belt 32 through a speed increasing transmission, indicated generally by 34, to an alternator 36 which acts as a source of resistance to the downward motion of the pedal 18. Providing an attachment point for the belt 32 to the pedal member 28 is a partial toothed pulley 31 which is secured to the pedal member 28. The transmission includes a one way clutch 37 having a pulley 38 that is engaged with the belt 32. A second pulley 40 is connected to the one way clutch 36 and is engaged with a second belt 42 which in turn is engaged to a third pulley 44 that is attached to an intermediate pulley 46. A third belt 48 is used to connect the intermediate pulley 46 to the alternator 36 via a pulley 50. The transmission 34 operates in a manner generally similar to the transmissions shown in U.S. Pat. Nos. Re. 34,959, 5,135,447 and 5,238,462. In addition, an upward restoring force is provided to the pedal member 28 by a spring 52 which is connected at one end to the belt 32 and at the other end to the frame 12 in an arrangement similar to the arrangement shown in U.S. Pat. No. Re. 34,959. For dependent type step machines, the restoring force is provided by a belt or chain that connects the pedals together through a transmission.

The pedal mechanism 30 includes a cable 54, preferrably a nylon jacketed commercial grade stainless steel cable, lead over and engaged with a pedal pulley 56 which is secured to the foot pedal 18 by fasteners or other methods such as welding or molded-in as one part to prevent rotation of the pedal pulley 56 with respect to the foot pedal 18. To provide for at least limited rotation of the foot pedal 18 with respect to the pedal member 28, the foot pedal 18 is rotatably mounted on a shaft 58 that is secured to the pedal member 28. Movement of the cable 54 with respect to the pedal pulley 56 is prevented by an engagement block 60 which is secured to or crimped over the cable 54 and positioned within a slot 62 configured in the rim of the pedal pulley 56. At the other end of the pedal member 28, a frame pulley 64 is secured to the frame 12 on a shaft 66, that in turn is connected to the frame 12 by a shaft support member 67, in such a manner so as to prevent rotation of the frame pulley 64 with respect to the frame 12. In the embodiment shown in FIG. 2, the pedal member 28 is rotatably mounted on the shaft 66 in order to allow the pedal member to pivot with respect to the frame 12 thereby permitting the end of the pedal member 28 having the foot pedal 18 to move up and down an a substantially vertical direction. As with the pedal pulley 58, the cable 54 is engaged with the frame pulley 64 by utilizing an engagement block which is secured to or crimped over the cable 54 and positioned within a slot 70 configured in the rim of the frame pulley 64. Tension is maintained in the cable 54 by a tensioning device 72. In the exemplary tensioning device 72 shown in FIG. 2, a bolt 74 is threaded through a pair of angled legs 76 and 78 that are joined at their lower ends by a pin 80. A pair of ball ends 82 and 84 are attached to each end of the cable 54 which in turn extend through apertures or keyhole shaped slots (not shown) in the legs 76 and 78. Tightening the bolt 74 will cause the legs 76 and 78 to move closer together and since the ends of the cable 54 are in effect attached to the legs 76 and 78 by the ball ends 82 and 84, sufficient tension can be applied to the cable 54 to retain engagement with the pedal pulley 56 and the frame pulley 64. It should be noted that other types of tensioning devices can be used with the cable 54 such as a turnbuckle or various types of clamping arrangements. Alternatively, tensioning can be provided by further separating the frame pulley 64 from the pedal pulley 56, for example, by loosening a fastener (not shown) securing the shaft support member to the frame 12 and rotating the shaft support member 67 downwardly.

As can be appreciated by the portrayal of the three positions of the pedal mechanism 30, 30' and 30" in FIG. 2, the top surface of the pedal 18 will be maintained level, or with a constant predetermined angle with respect to the horizontal plane, as the pedal member 28 moves in an arcuate path indicated by an arrow 86 if the pedal pulley 56 and the frame pulley 64 have the same diameter. The cable 54 will, since it is engaged with the pedal pulley 56 and the frame pulley 64, cause the pedal pulley 56, and hence the pedal member 18, to rotate on the shaft 58 at the same angular rate as the pedal member 28 rotates on the shaft 66. Because the angular rates of rotation are the same, the top surface of the pedal 18 will retain a constant orientation with respect to the horizontal plane through the entire range of vertical motion of the pedal member 28. As a result, the foot pedal 18 can provide a level surface for the user's foot even though the pedal member 28 is traveling in an arcuate path 86.

In addition, the pedal mechanism 30 of FIG. 2 has the capability to provide a predetermined amount of tilting of the foot pedal 18 with respect to the horizontal plane as the user steps up and down. For example, if the diameter of the pedal pulley 56 is smaller than the frame pulley 64, the pedal pulley 56 will rotate at a greater angular rate than the pedal member 28 resulting in a forward or back tilting of the foot pedal 18. Therefore, by selecting the appropriate diameters for the pulleys 56 and 64, it is possible to provide for a change in the angular tilt of the foot pedal 18 as the pedal member 28 moves up and down in the path 86. Further modifications of the action of the foot pedal 18 can be achieved by providing the pedal pulley 56 with a cam profile. As a result, it is possible to design the pedal mechanism 30 such that the orientation of the user's foot with respect to the horizontal plane for various positions of the foot pedal 18 along the vertical step path 86 can be optimized to provide the most comfortable step action.

Figure 3:
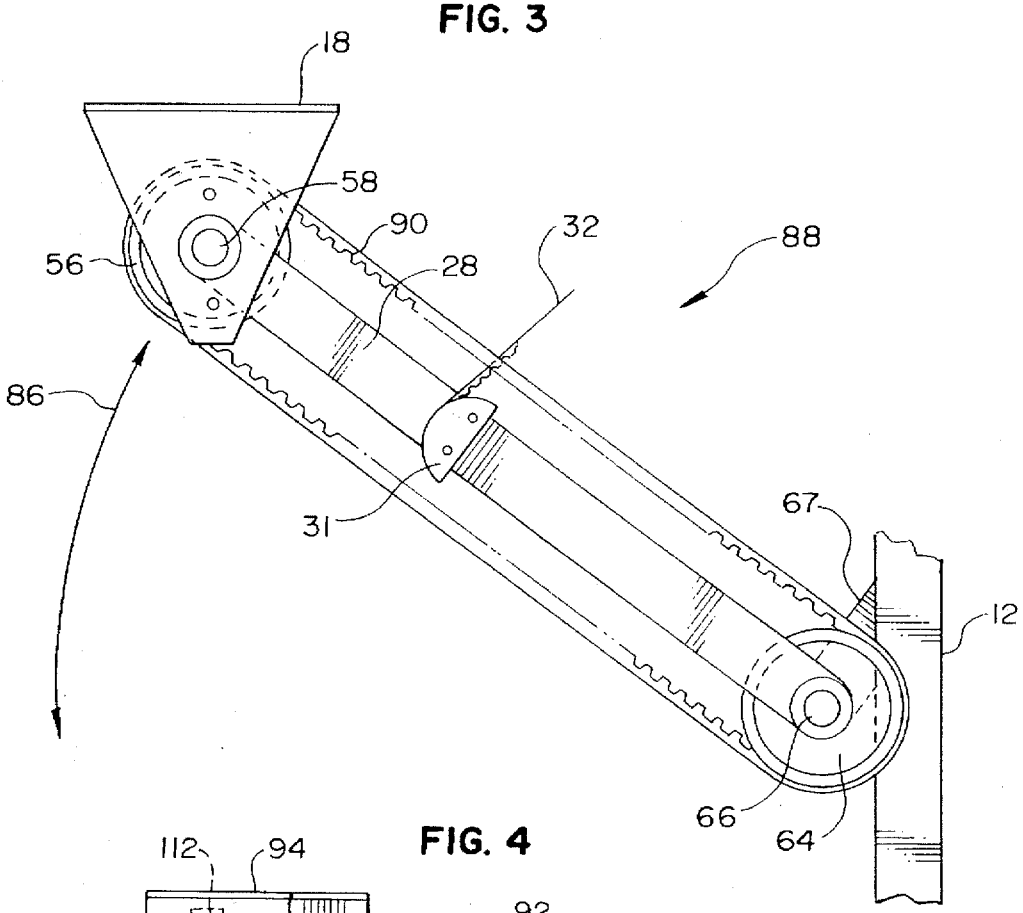
FIG. 3 is a side view of a second embodiment of the pedal mechanism utilizing a belt and pulley arrangement.

Illustrated in FIG. 3 is a second embodiment of a pedal mechanism 88 for use with the stairclimber 10. The pedal mechanism 88 is essentially the same as the pedal mechanism 30 of FIG. 2 except that the cable 54 is replaced by a toothed belt 90. In addition, both the pedal pulley 56 and the frame pulley 64 are configured with teeth (not shown) for engaging the belt 90. Preferably the belt 90 is a neoprene timing belt with a glass or Kelvar tension cord and nylon fabric tooth facings. Because the belt 90 as well as the cable 54 are more compliant than rigid steel arms, some degree of elasticity can be introduced into the pedal mechanisms 30 and 88 that permits a limited motion of the foot pedal 18 under the user's foot thereby increasing the comfort level associated with a step action on the stairclimber 10.

Figure 4:
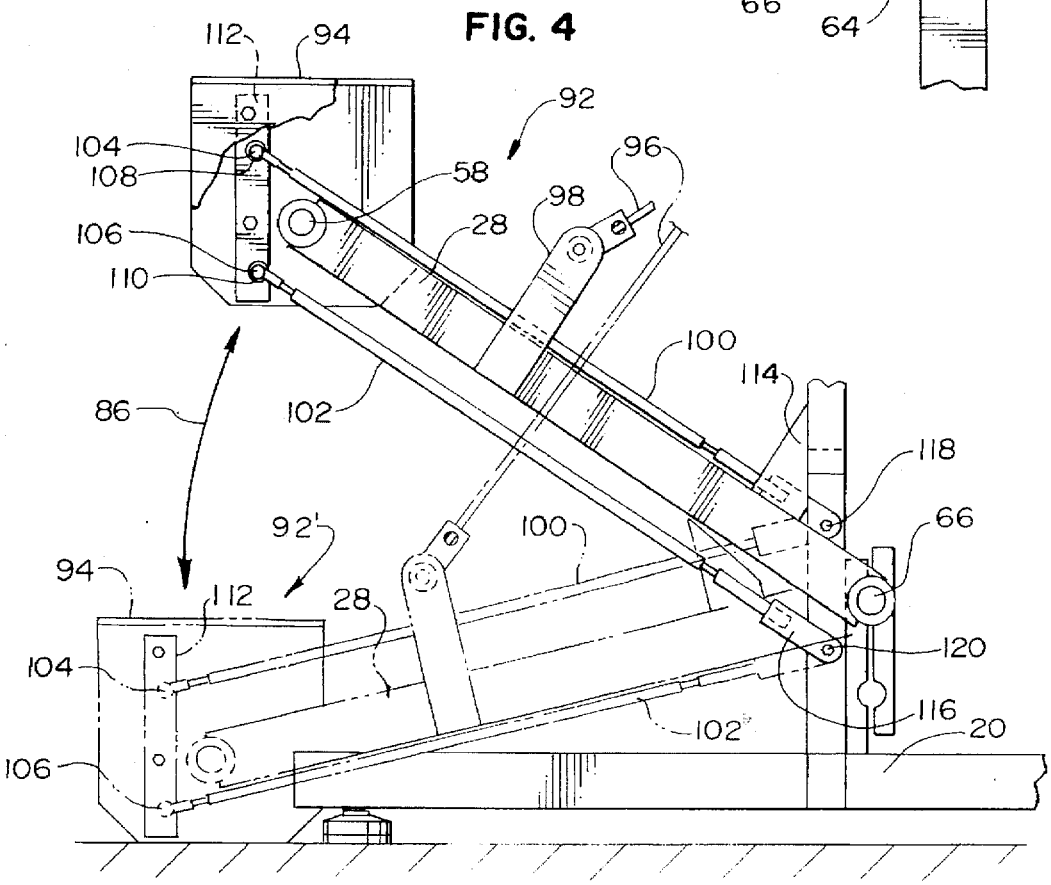
FIG. 4 is a side view of a third embodiment of the pedal mechanism utilizing two cables.

FIG. 4 shows a third embodiment of a pedal mechanism in two different positions as indicated at 92 and 92'. In this embodiment of the pedal mechanism 92, a foot pedal 94 is rotatably connected to the shaft 58 which, as with the pedal mechanisms 30 and 88 of FIGS. 2 and 3, is connected to the pedal member 28. The foot pedal 94 has the same arcuate motion as the foot pedal 18 as indicated by the arrow 86. Also, the pedal member 28 can be connected to a transmission similar to the transmission 34 by a cable 96 or a belt such as 32 attached to the pedal member 28 via a tab 98. The foot pedal 94 is connected to the frame 20 by a pair of flexible cables 100 and 102. As shown in FIG. 4, a pair of ball ends 104 and 106 are attached one end of each cable 100 and 102 and are rotatably secured within a pair of sockets 108 and 110 configured in a bracket 112 which in turn is secured to the foot pedal 94. It should be noted that the upper cable 100 is attached at a point 104 above the pivot point of the foot pedal 94 at the shaft 58 and the other cable 102 is attached at a point 106 below the pivot point of the foot pedal 94. The other ends of the cables 100 and 102 are rotatably connected to the frame 20 by a pair of tabs 114 and 116. A pair of pins 118 and 120 are used to attach the tabs 114 and 118 to the frame 20 so as to permit the tabs 114 and 118 to rotate with respect to the frame 20. As indicated by the illustration of the two positions of the pedal mechanism 92 and 92' in FIG. 4, the cables 100 and 102, because they have the same length, will maintain the top surface of the foot pedal 94 level through out the motion 86 of the pedal member 28.

Because the pedal mechanisms 30 and 92 shown in FIGS. 2, 3 and 4 utilize flexible members 54, 90, 100 and 102 to control the orientation of the pedal members 18 and 94 in the same fundamental manner, it is possible to substitute components to achieve the same results. For example, the pedal mechanism 94 can be modified by joining the ends 104 and 106 of the two cables 100 and 102 to form a single cable and leading this cable over the type of pedal pulley 56 used in pedal mechanism 30. By the same token, the other ends of the cables 100 and 102 can be joined together and engaged with the type of frame pulley 64 used in the pedal mechanism 30. It will be appreciated that stairclimbers are used in a variety of environments from relatively light usage home units to very heavily used health club units where maintenance and component life are significant considerations. Also, user preferences for pedal orientation can differ. Therefore, the pedal mechanisms described above have a significant advantage because, depending on the type of stairclimbing apparatus, operating environment and user preferences, it is possible to combine the elements, such as the single flexible members 54 or 90 or the two cables 100 and 102 so as to provide a mechanism that will achieve an optimum balance of wear, feel and pedal orientation.

We claim:

1. A simulated stairclimbing apparatus comprising:

a stationary frame;

a foot pedal;

a substantially rigid pedal member having a first end rotatably secured to said foot pedal and a second end pivotally secured to said frame so as to permit limited arcuate movement of said foot pedal in a substantially vertical direction between an upper step position and a lower step position;

a flexible transmission member connected to said pedal member;

resistance means secured to said frame for applying a resistance force to said pedal member;

transmission means operatively connected to said resistance means and said flexible transmission member for transmitting said resistance force to said pedal member;

a first flexible member having a first end rotatably connected to said frame and its second end rotatably connected to said foot pedal; and a second flexible member of substantially equal length to said first flexible member having a first end rotatably connected to said frame and its second end rotatably connected to said foot pedal wherein said pedal member is located between said first and second flexible members so that the rotatable connections of the first and second flexible members are located symmetrically above and below the rotatable connections of the pedal member wherein said rotatable connections of said first and second flexible members are effective to maintain said first and second flexible members substantially parallel to said pedal member so as to maintain said foot pedal level throughout the motion of said foot pedal.

2. A simulated stairclimbing apparatus comprising:

a stationary frame;

a foot pedal;

a pedal member having a first end rotatably secured to said foot pedal and a second end pivotally secured to said frame so as to permit limited arcuate movement of said foot pedal in a substantially vertical direction between an upper step position and a lower step position;

a flexible transmission member connected to said pedal member;

resistance means secured to said frame for applying a resistance force to said pedal member;

transmission means operatively connected to said resistance means and said flexible transmission member for transmitting said resistance force to said pedal member;

a pedal pulley fixed to said foot pedal so as to prevent rotation with respect to said foot pedal;

a frame pulley fixed to said frame so as to prevent rotation with respect to said frame; and a flexible member engaged with both said pedal pulley and said frame pulley wherein said flexible member has a first and a second end joined together to form a continuous loop and is engaged over said pedal pulley and frame pulley to prevent movement with respect to said pedal pulley and said frame pulley.

3. The apparatus of claim 2 wherein said flexible member is a cable.

4. The apparatus of claim 3 includes tensioning means for tensioning said cable.

5. The apparatus of claim 2 wherein said flexible member is a single belt.

6. The apparatus of claim 5 wherein said belt is a toothed belt and said pedal and frame pulleys are toothed pulleys.

7. The apparatus of claim 1 wherein said first flexible member is attached to said foot pedal above the point where said foot pedal is attached to said pedal member and wherein said second flexible member is attached to said foot pedal below the point where said foot pedal is attached to said pedal member.

8. A simulated stairclimbing apparatus comprising:

a stationary frame;

a foot pedal;

a pedal member having a first end rotatably secured to said foot pedal and a second end pivotally secured to said frame so as to permit limited arcuate movement of said foot pedal in a substantially vertical direction between an upper step position and a lower step position;

a flexible transmission member connected to said pedal member;

resistance means secured to said frame for applying a resistance force to said pedal member;

transmission means operatively connected to said resistance means and said flexible transmission member for transmitting said resistance force to said pedal member;

a pedal pulley fixed to said foot pedal so as to prevent rotation with respect to said foot pedal;

a frame pulley fixed to said frame so as to prevent rotation with respect said frame; and a flexible member engaged with both said pedal pulley and said frame pulley wherein said flexible member has a first and a second end joined together to form a continues loop and is engaged over said pedal pulley and frame pulley to prevent movement with respect to said pedal pulley and said frame pulley.

9. The apparatus of claim 8 wherein said flexible member is a cable.

10. The apparatus of claim 9 wherein said foot pulley and said frame pulley each are configured with an engagement slot and said cable includes a first engagement block positioned within said frame pulley slot and a second engagement block positioned within said foot pulley engagement slot.

11. The apparatus of claim 8 additionally including tensioning means for said flexible member.

12. The apparatus of claim 8 wherein said flexible member is a belt.

13. The apparatus of claim 12 wherein said belt is a toothed belt and said frame pulley and said foot pulley include teeth for engaging said toothed belt.

14. The apparatus of claim 8 wherein the diameter of said frame pulley and said foot pulley are equal.

15. The apparatus of claim 8 wherein the diameter of said frame pulley is greater than the diameter of said foot pulley.

16. The apparatus of claim 8 wherein the diameter of said frame pulley is smaller than the diameter of said foot pulley.

17. The apparatus of claim 1 wherein each of said first ends of said first and second flexible members includes a ball end and said pedal member includes a pair of sockets for receiving said ball ends.

18. The apparatus of claim 1 wherein said frame includes a first and a second tab each rotatably connected to said frame and connected to said second ends of said first and second flexible members.

* * * * *